United States Patent [19]

Takimoto et al.

[11] 4,112,898

[45] Sep. 12, 1978

[54] INTERNAL COMBUSTION ENGINE WITH CHARCOAL CANISTER

[75] Inventors: Masatami Takimoto, Toyota; Koichi Mizutani, Seto, both of Japan

[73] Assignee: Toyota Jidosha Kogyo Kabushiki Kaisha, Toyota, Japan

[21] Appl. No.: 785,671

[22] Filed: Apr. 7, 1977

[30] Foreign Application Priority Data

Jan. 13, 1977 [JP] Japan ..... 52-1940

[51] Int. Cl.[2] ..... F02M 33/02

[52] U.S. Cl. ..... 123/136; 60/293

[58] Field of Search ..... 123/136; 60/293

[56] References Cited

U.S. PATENT DOCUMENTS

| | | | |
|---|---|---|---|
| 3,191,587 | 6/1965 | Hall | 123/136 |
| 3,653,212 | 4/1972 | Gast et al. | 60/293 |
| 3,658,042 | 4/1972 | Balluff | 123/136 |
| 3,680,318 | 8/1972 | Nakajima et al. | 123/136 |
| 3,913,545 | 10/1975 | Haase et al. | 123/136 |
| 4,031,869 | 6/1977 | Onishi et al. | 123/136 |

*Primary Examiner*—Charles J. Myhre
*Assistant Examiner*—Andrew M. Dolinar
*Attorney, Agent, or Firm*—Stevens, Davis, Miller & Mosher

[57] ABSTRACT

Disclosed is an internal combustion engine provided with a charcoal canister for absorbing evaporative fuel issued from the fuel tank and/or the float chamber of the engine. A pipe is provided between the canister and the intake manifold which is always located downstream of the throttle valve of the engine, for desorbing the absorbed evaporative fuel by the flow of purge air which flow is formed in the canister under the influence of a vacuum existing in the intake manifold. Thus, the evaporative fuel can still be introduced into the engine even if the throttle valve is in its idle position.

1 Claim, 1 Drawing Figure

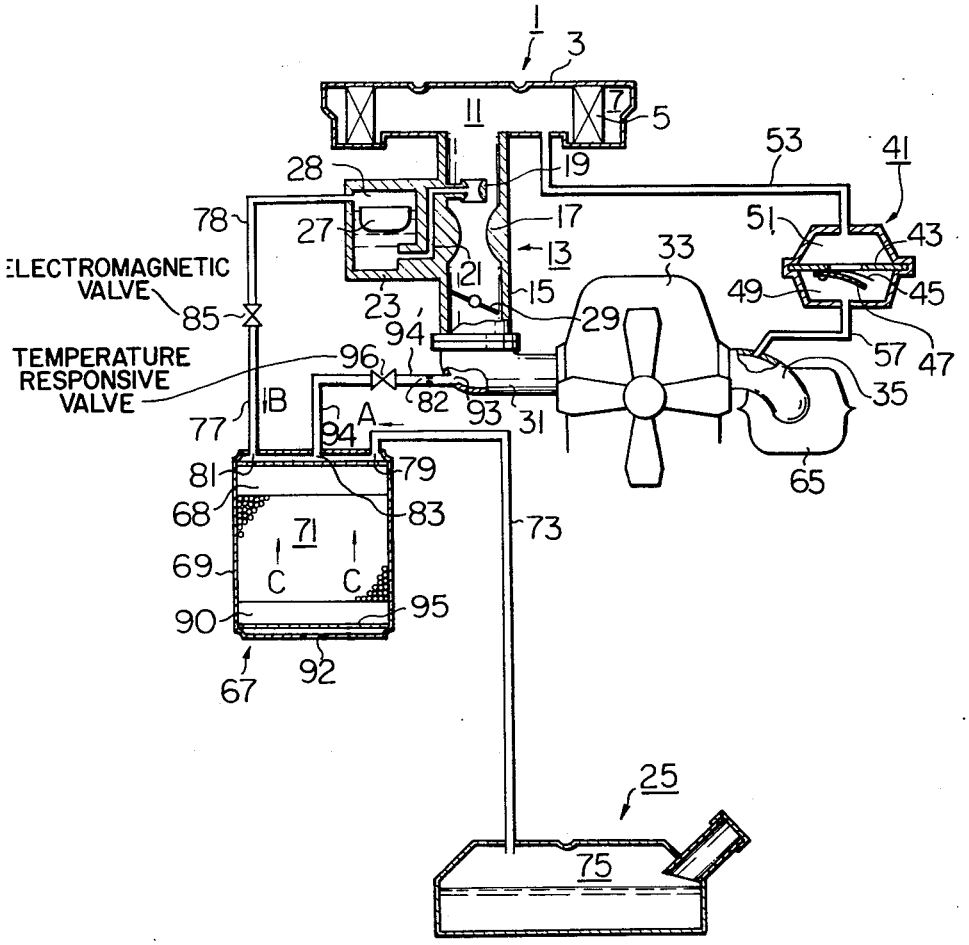
ELECTROMAGNETIC VALVE
TEMPERATURE RESPONSIVE VALVE
1
3
5
7
11
13
15
17
19
21
23
25
27
28
29
31
33
35
41
43
45
47
49
51
53
57
65
67
68
69
71
73
75
77
78
79
81
82
83
85
90
92
93
94
95
96
A
B
C

INTERNAL COMBUSTION ENGINE WITH CHARCOAL CANISTER

DESCRIPTION OF THE INVENTION

The present invention relates to an internal combustion engine provided with a charcoal canister.

In an internal combustion engine, it is necessary to communicate a space formed in a fuel tank above the surface of liquid fuel, as well as a space formed in a carburetor float chamber above the surface of liquid fuel, with the outside atmosphere. If these spaces in the fuel tank and the float chamber are directly opened to the atmosphere, the evaporative fuel is emitted to the atmosphere, due to the low boiling temperature of the engine fuel, causing public pollution which is now legally restricted.

In order to prevent the evaporation fuel emission, an internal combustion engine is known which has a charcoal canister arranged between the spaces in the fuel tank and in the float chamber, and the atmosphere. According to this device, the evaporative fuel is absorbed by the charcoal layer of the canister. The thus absorbed fuel is desorbed by the flow of purge air introduced into the purge air opening of the canister under the influence of the vacuum pressure formed in the intake system when the throttle valve is opened, thereby the throttle valve is moved upstream of a fuel introducing port. The thus desorbed fuel is introduced into the engine via the fuel introducing port. Since this port is located slightly upstream of the throttle valve when it is in its idle position, the evaporative fuel cannot be introduced into the engine when the engine is operating under an idle condition.

Since evaporative fuel emissions are now under legal control, for the prevention of pollution it is necessary to increase the total amount of evaporative fuel introduced into the engine. Therefore, in the known engine, it is necessary to increase the amount of evaporative fuel introduced into the engine when the engine is operating under a condition of a relatively high rotational speed in which the throttle valve is rotated from the idle position. This causes an increase in the amount of unburnt components exhausted into the exhaust manifold. In order to prevent the unburnt components from being emitted into the atmosphere, it is necessary to increase the amount of secondary air introduced into the exhaust manifold during the condition of a relatively high rotational speed. However, this causes to a drawback to occur wherein the catalytic converter is easily overheated.

Therefore an object of the present invention is to provide an internal combustion engine wherein the amount of evaporative fuel introduced into the engine can be increased without causing the occurrence of the above-mentioned drawback.

Provided is an internal combustion engine comprising: an engine body: a carburetor for forming a combustible air fuel mixture, which carburetor being provided with a throttle valve for controlling an amount of the mixture; an intake system located downstream of the throttle valve for supplying the air-fuel mixture to the engine body; an exhaust system for receiving the resultant exhaust gas from the engine body; a secondary air introducing system adapted for introducing secondary air into the exhaust system; an exhaust gas purifying system for oxidizing unburnt toxic components remaining in the exhaust gas together with the secondary air; a charcoal canister which includes a casing and a charcoal layer arranged in the casing, said casing having on one side thereof a first opening communicating with the atmosphere for introducing purge air into the casing and having on the other side thereof a second opening and a third opening; a first pipe means which connects the second opening with the engine at a place where the evaporation of fuel takes place for introducing evaporative fuel into the charcoal layer wherein the evaporative fuel is caused to be absorbed by the charcoal layer; and a second pipe means which connects the third opening with the engine intake system, said second pipe means having an orifice. Thus, even if the engine is in such a running condition that the throttle valve is in its idle position, a controlled amount of the absorbed evaporative fuel can be desorbed and introduced into the intake system by the flow of the purge air formed in the charcoal layer from the first opening to the third opening under the influence of a vacuum in the engine intake system. Therefore, the unburnt fuel remaining in the exhaust system due to the introduction of evaporative fuel during such a running condition can be effectively oxidized in the exhaust gas purifying system by the excess amount of secondary air which is introduced into the exhaust system by the secondary air introducing system when the engine is operating under the above-mentioned running condition.

The present invention will now be described with reference to the accompanying drawing which schematically shows one embodiment of the internal combustion engine according to the present invention.

In the drawing, showing an embodiment of an internal combustion engine according to the present invention, the numeral 1 designates an air cleaner which has a case 3. A tubular filter element 5 is disposed in the case 3 so that a space 7 is formed in the case 3 on the outer side of the element 5 and that a space 11 is formed on the inner side of the element 5. A carburetor 13 is located below the air cleaner 1 in such a manner that it communicates with the space 11 of the cleaner 1.

The carburetor 13 has a barrel 15 which forms a large venturi 17 therein. A small venturi 19 is located above the large venturi 17. A float chamber 23 is formed on one side of the barrel 15, which chamber 23 is connected via a fuel supply passageway 21 to the small venturi 19. The float chamber 23 is connected via a not shown needle valve and a fuel pipe (not shown) to a fuel tank 25, so that fuel from the tank 25 can be introduced into the float chamber 23 via the not shown fule pipe and supplied to the small venturi 19 via the passageway 21. A float 27 in the float chamber 23 operates to keep a predetermined constant level of the fuel in the float chamber 23. A throttle valve 29 is located below the large venturi 17.

Connected to the carburetor 13 is an intake manifold 31 adapted for introducing an air-fuel mixture into the respective combustion chambers (not shown) in an engine body 33. The exhaust gas resulting from the combustion of the air-fuel mixture in the engine body 33 is received by an exhaust manifold 35.

The internal combustion engine is provided with a secondary air introducing system of the so-called air suction type. This system comprises a reed valve 41 which is opened by negative pressure intermittently formed in the exhaust manifold, in order to introduce a secondary air into the exhaust manifold 35. The reed valve 41 has a plate-shaped valve seat 43 which forms on one side thereof, a chamber 49 connected to the exhaust manifold 35 via a secondary air introducing pipe 57, and on the other side thereof, another chamber 51 connected to the space 11 via a secondary air intake pipe 53. In the chamber 49, a reed member 45 made of a thin metallic is, on one end of thereof, fixedly secured to the valve seat 43 together with an arc-shaped stopper member 47. The reed member 45 is detached from the valve seat 43, when the pressure in the chamber 49 becomes negative due to the pulsation of the pressure of the exhaust gas in the exhaust manifold 35. Thus, an amount of secondary air, which amount corresponds to the number of the pulsations (in other words, to the rotational speed of the engine), is "sucked" into the exhaust manifold 35.

A catalytic converter 65 is connected to the exhaust manifold 35. This catalytic converter 65 operates to oxidize, together with the secondary air sucked into the exhaust manifold 35, unburnt HC and CO components remaining in the exhaust gas.

Number 67 designates a charcoal canister adapted for absorbing evaporative fuel from the float chamber 23 and the fuel tank 25. The charcoal canister device 67 includes a tubular casing 69 and a charcoal layer 71. The layer 71 is arranged in the casing 69 so that a space 68 is formed on one side of the charcoal layer 71 in the casing 69 and another space 90 is formed on the other side of the layer 71 opposite to the space 68. On the end of the casing 69 adjacent to the space 68 openings 79, 81, 83 are formed. The opening 79 communicates with a space 75 located above the surface of the fuel tank 25 via a tube 73, in order to introduce evaporative fuel located in the space 75 of the fuel tank 25 into the space 68 of the canister 67 as shown by an arrow A. The opening 81 communicates with a space 28 located above the surface of the fuel in the float chamber 23, via a pipe 77, an electromagnetic valve 85 and a pipe 78. The electromagnetic valve 85 operates, in the known manner, to permit the fluidal communication between the pipes 77 and 78 when the engine is stopped, in order to permit the introduction of evaporative fuel in the space 28 into the space 68 of the canister 67, as shown by an arrow B. The valve 85 operates to prevent the fluidal communication between the pipes 77 and 78 when the engine is operating, in order to maintain a constant air-fuel ratio determined by the carburetor 13.

The opening 83 is connected to the intake system of the engine, as will be fully described later, in order to introduce the evaporative fuel absorbed by the charcoal layer 71 into the engine.

On the other end of the casing 69 adjacent to the space 90, an opening 92 is formed for introducing purge air into the charcoal layer 71. A filter plate 95 is arranged across the space 90.

The above-mentioned construction of the internal combustion is substantially the same as that of the known art. In the known art, the opening 83 is opened to the carburetor 13 at a fuel introducing port (not shown) located slightly above the throttle valve 29 when the throttle valve 29 is in its idle position. Thus, in the known art, the evaporative fuel in the canister 67 cannot be introduced into the engine when the engine is operating under an idle condition when the throttle valve 29 is being moved from the idle position to locate the fuel introducing port downstream of the throttle valve 29. The flow of purge air from the purge air opening 92 is generated in the charcoal layer 71 as shown by an arrow C under the vacuum pressure formed in the carburetor 13 at a position located downstream of the throttle valve 29. Thus, the evaporative fuel which has been absorbed by the charcoal layer 71 is desorbed by the flow of the purge air and then introduced into the carburetor.

In this known art a large amount of evaporative fuel should be introduced into the engine during a condition of a relatively high rotational speed in which the throttle valve is moved from the idle position since the evaporative fuel emission is now legally restricted. However, increasing the amount of evaporative fuel introduced into the engine during the condition of a relatively high speed causes the occurrence of a drawback wherein a large amount of unburnt components remains in the resultant exhaust gas, since the flow characteristic of the reed valve 41 is so adjusted that no excess secondary air can be sucked into the exhaust manifold 35, when the engine is operating under a condition of a relatively high rotational speed. Therefore, in order to oxidize the unburnt components in the catalytic converter, it is necessary to readjust the reed valve 41 to increase the amount of secondary air sucked into the exhaust manifold 35 via the reed valve 41. However, as a result the rotational speed is greatly increased and in turn causes the catalytic converter 65 to become overheated.

According to the present invention, in order to introduce a large amount of evaporative fuel into the engine without the occurrence of the above-mentioned drawback, the opening 83 of the canister 67 must be connected to a port 93 in the intake manifold 31, which port 93 being always located downstream of the throttle valve 29, via an evaporative air introducing pipe 94 a temperature detecting valve 96 and a pipe 94'. Provided in the pipe 94' is an orifice 82 for controlling the amount of evaporative fuel passing through the pipe 94'. The temperature detecting valve 96 located between the pipes 94 and 94' operates to prevent a fluidal communication therebetween when the temperature of the engine, the temperature of the intake air, or the temperature of the carburetor, is abnormally increased.

According to the present invention, since the opening 83 of the canister 67 is opened to the port 93 formed in the intake manifold 31, the port 93 is always located downstream of the throttle valve 29, the evaporative fuel absorbed by the charcoal layer 71 can, even if the throttle valve 29 is in its idle position, be desorbed and introduced into the engine by the flow of purge air formed in the charcoal layer 71, as shown by the arrow C. Therefore, the amount of unburnt components remaining in the exhaust manifold 35 is increased during the idle condition. However, this increased amount of unburnt components can be effectively oxidized by the secondary air sucked into the exhaust manifold 35 from the air cleaner 1 via the pipe 57, the reed valve 41 and the pipe 53. This is because the reed valve 41 has such a flow characteristic that an excess amount of secondary air is sucked into the exhaust manifold 35 during the idle condition.

The orifice 82 controls the amount of evaporative fuel introduced into the engine. To prevent a misfire from occurring due to an overly rich air-fuel mixture being introduced into the engine during the idle condition, the dimension of the orifice is specially selected to make certain so that an excessively large amount of evaporative fuel is not introduced into the engine.

To prevent too much evaporative fuel from being introduced into the engine, which causes the occurrence of a misfire, when the temperature of the engine is abnormally increased, the temperature detecting valve 96 operates in the same way as a well-known manner, to shut the fluidal communication between the pipes 94 and 94', when the temperature of the engine cooling water or the temperature of the carburetor is abnormally increased.

In the above-described embodiment, the so-called air suction type secondary air introducing apparatus is used. However, other types of secondary air introducing apparatuses can be used.

What is claimed is:

1. An internal combustion engine comprising: an engine body;

a carburetor for forming a combustible air-fuel mixture, said carburetor being provided with a throttle valve for controlling an amount of said mixture:

an intake system located downstream of said throttle valve, for supplying said air-fuel mixture to said engine body;

an exhaust system for receiving the resultant exhaust gas from said engine body;

a secondary air introducing system adapted for introducing secondary air into said exhaust system;

an exhaust gas purifying system for oxidizing unburnt toxic components remaining in the exhaust gas together with the secondary air;

a charcoal canister which includes a casing and a charcoal layer arranged in said casing, said casing having on one side thereof a first opening communicating with the atmosphere for introducing purge air into said casing and having on the other side thereof a second opening and a third opening;

a first pipe means which connects the second opening with the engine at a place where the evaporation of fuel takes place for introducing evaporative fuel into the charcoal layer wherein the evaporative fuel is caused to be absorbed by the charcoal layer;

a second pipe means which connects the third opening with the engine intake system said second pipe means having an orifice for producing a controlled amount of said absorbed evaporative fuel into said intake system; and, temperature responsive valve means provided in said second pipe means for preventing the introduction of evaporative fuel into said intake system when the temperatue of said engine is extremely increased.

* * * * *